US007141291B2

(12) United States Patent
Crow

(10) Patent No.: US 7,141,291 B2
(45) Date of Patent: Nov. 28, 2006

(54) WINDOW TREATMENT FORMATION ASSEMBLIES OF FIBROUS FELT CONSTRUCTION

(75) Inventor: Susan K. Crow, Simpsonville, SC (US)

(73) Assignee: The Felters Group, Roebuck, SC (US)

( * ) Notice: Subject to any disclaimer, the term of this patent is extended or adjusted under 35 U.S.C. 154(b) by 54 days.

(21) Appl. No.: 10/850,301

(22) Filed: May 20, 2004

(65) Prior Publication Data

US 2005/0019525 A1 Jan. 27, 2005

Related U.S. Application Data

(60) Provisional application No. 60/472,331, filed on May 21, 2003.

(51) Int. Cl.
*B32B 3/04* (2006.01)

(52) U.S. Cl. ..... 428/124; 160/19

(58) Field of Classification Search ..... 428/121, 428/167; 442/361, 364, 402, 415; 160/38, 160/39

See application file for complete search history.

(56) References Cited

U.S. PATENT DOCUMENTS

| | | | | |
|---|---|---|---|---|
| 2,637,380 | A * | 5/1953 | Hyde | 160/38 |
| 4,863,776 | A * | 9/1989 | Sternlieb | 428/102 |
| 5,194,310 | A * | 3/1993 | Lenderink | 428/90 |
| 2004/0028958 | A1 * | 2/2004 | Assink et al. | 428/920 |

* cited by examiner

*Primary Examiner*—Colleen P. Cooke
*Assistant Examiner*—Paul Wartalowicz
(74) *Attorney, Agent, or Firm*—J. M. Robertson; Intellectual Prop, LLC

(57) ABSTRACT

Window treatment structures formed from a felted fibrous material such as needle punched felt as the material of construction. The felted fibrous material is adapted to accept grooved score lines to define living hinges for bending of the material to form top and/or side portions of the finished structure using a singe panel of such material.

6 Claims, 8 Drawing Sheets

WINDOW TREATMENT FORMATION ASSEMBLIES OF FIBROUS FELT CONSTRUCTION

CROSS-REFERENCE TO RELATED APPLICATIONS

This application claims the benefit of and priority from my U.S. Provisional Application 60/472,331 filed May 21, 2003, the contents of which are incorporated herein in their entirety.

TECHNICAL FIELD

The present invention relates generally to window treatment structures such as cornices, lambrequins and the like. More particularly, the present invention relates to such structures of single or multi-piece construction formed from felted fibrous materials having a controlled degree of flexibility while maintaining substantial stability and strength. Such structures may be used in residential, commercial or hotel environments.

BACKGROUND OF THE INVENTION

Window treatment structures such as cornices and lambrequins are well known. Typically in the past such structures have been formed from board stock materials such as wood or the like with segments of such material being cut to predefined shapes and thereafter being nailed, stapled or glued together to yield a desired construction. While such materials have been useful, they have faced limitations due to their relatively high weight as well as their inability to be easily bent to different geometries.

SUMMARY OF THE INVENTION

This invention provides advantages and alternatives over the prior art by providing window treatment structures formed from a felted fibrous material such as needle punched felt as the material of construction in replacement for wood. The felted fibrous material is adapted to provide adequate strength to permit construction of three dimensional structures by use of standard joining techniques such as screws, nails, glue and the like if desired. The felted fibrous material is also adapted to accept grooved score lines to define living hinges for bending of the material to form top and/or side portions of the finished structure. Thus, the felted fibrous material affords the opportunity to bend and shape the material thereby allowing additional freedom in construction and use.

BRIEF DESCRIPTION OF THE DRAWINGS

The present invention will now be described by way of example only, with reference to the accompanying drawings which constitute a portion of the specification herein and in which.

While the present invention has been illustrated and generally described above and will hereinafter be described in conjunction with certain potentially preferred embodiments, procedures, and practices, it is to be understood that in no case is the invention to be limited to such illustrated and described embodiments, procedures, and practices. On the contrary, it is intended that the present invention shall extend to all alternatives, modifications, and equivalents as may embrace the principles of the present invention within the true scope and spirit thereof.

DESCRIPTION

Figure 1:
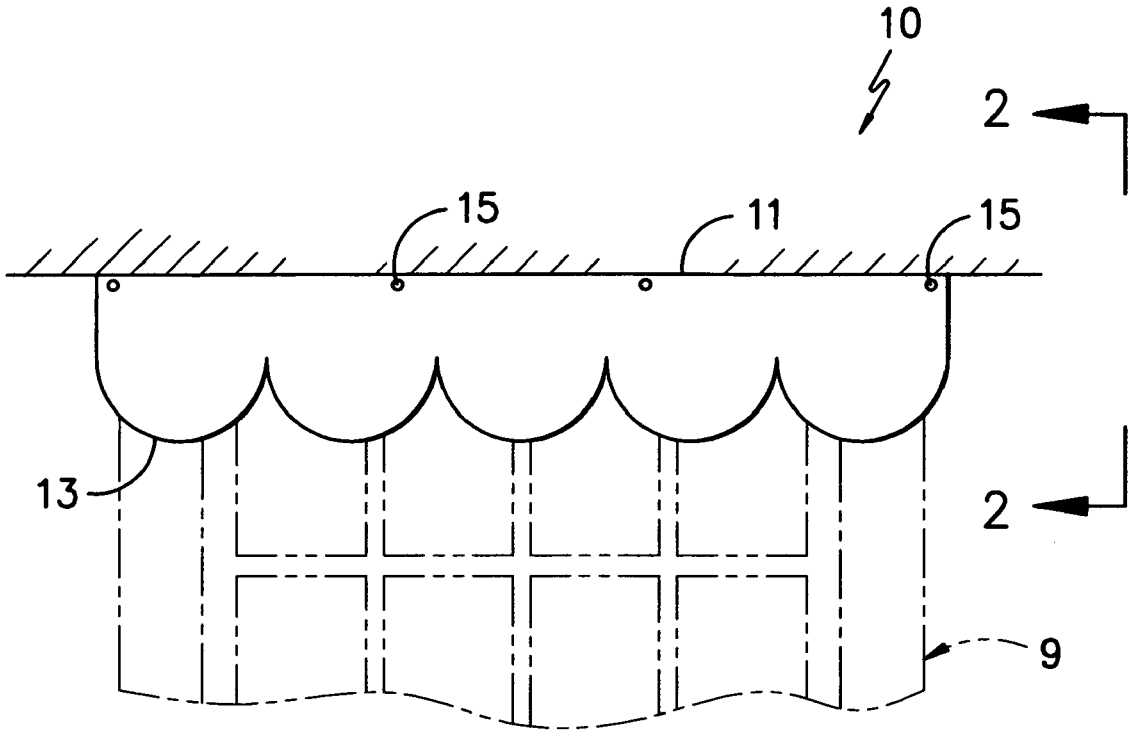
FIG. 1 is a view of the face of an exemplary box-like window cornice structure.
Figure 2:
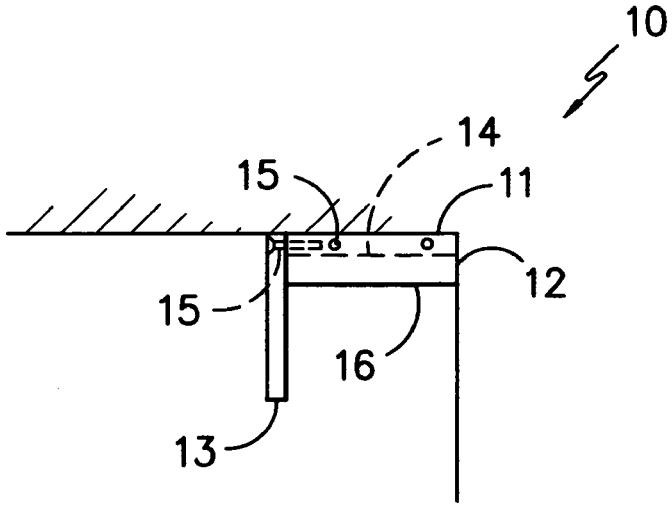
FIG. 2 is a view taken along line 2—2 in FIG. 1.

Reference will now be made to the drawings, wherein, to the extent possible, like reference numerals are utilized to designate like components throughout the various views. In FIGS. 1 and 2 there is illustrated an exemplary window cornice 10 for disposition in overhanging relation to a window designated generally as 9. As illustrated, the cornice is of a substantially open bottom box-like construction so as to hang below a ceiling 11 and away from a wall 12. As will be appreciated, while the upper surface of the cornice 10 is illustrated as being in abutting relation to the ceiling 11, it may likewise be disposed at positions substantially below the ceiling 111 if desired.

In the exemplary construction illustrated in FIGS. 1 and 2, the cornice 10 includes a face board or face panel 13 of felted material as will be described further hereinafter affixed to the front edge of a dust board or top board 14 of felted material by fastening elements 15 such as screws, nails or the like. As will be described further hereinafter, the face panel 13 and the dust board 14 may also be formed as one piece with a score line defining a living hinge at the intersection. If desired, lateral side boards or returns 16 of felted material extend away from the face panel towards the wall 12. The side boards 16 may be affixed to the sides of the top board 14 by fastening elements 15. The side boards may also be formed as bendable wings extending away from the lateral sides of the face panel in the finished construction. In such a configuration bending takes place along one or more vertical score lines. The side boards may extend partially or completely along the length of the face panel. Upon construction, the cornice thus defines a box-like structure. In the event that no sideboards are utilized, a so called "valence" construction is obtained. A decorative fabric cover may be affixed across the surface of the cornice or valence by gluing, stapling or the like.

Figure 3:
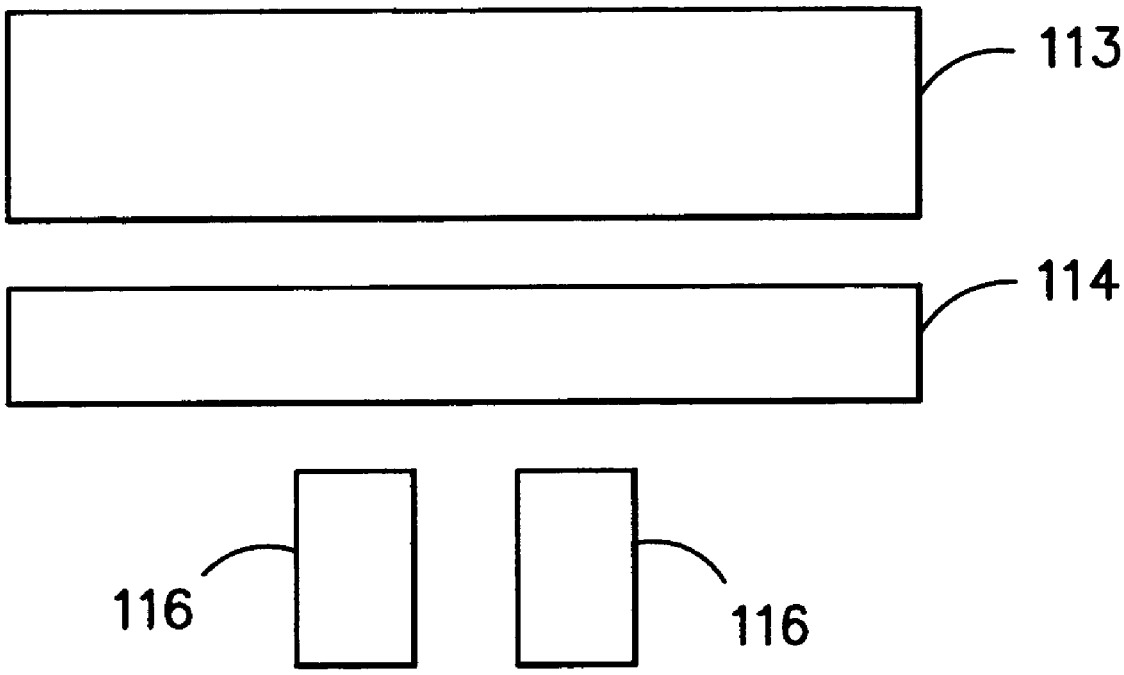
FIG. 3 illustrates the components of a kit of flat stock material components for formation of a window cornice structure.

In FIG. 3, a first kit of stock material components for formation of a window cornice structure is illustrated wherein elements corresponding to those previously described are designated by like reference numerals in a 100 series. As shown, in this arrangement the face panel 113, the dust board 114 and the returns or side boards 116 are each formed as a separate panels of desired geometry from felted construction material. The individual panels can then be fastened together with nails, screws, glue or the like to form a desired cornice or valence construction.

Figure 4:
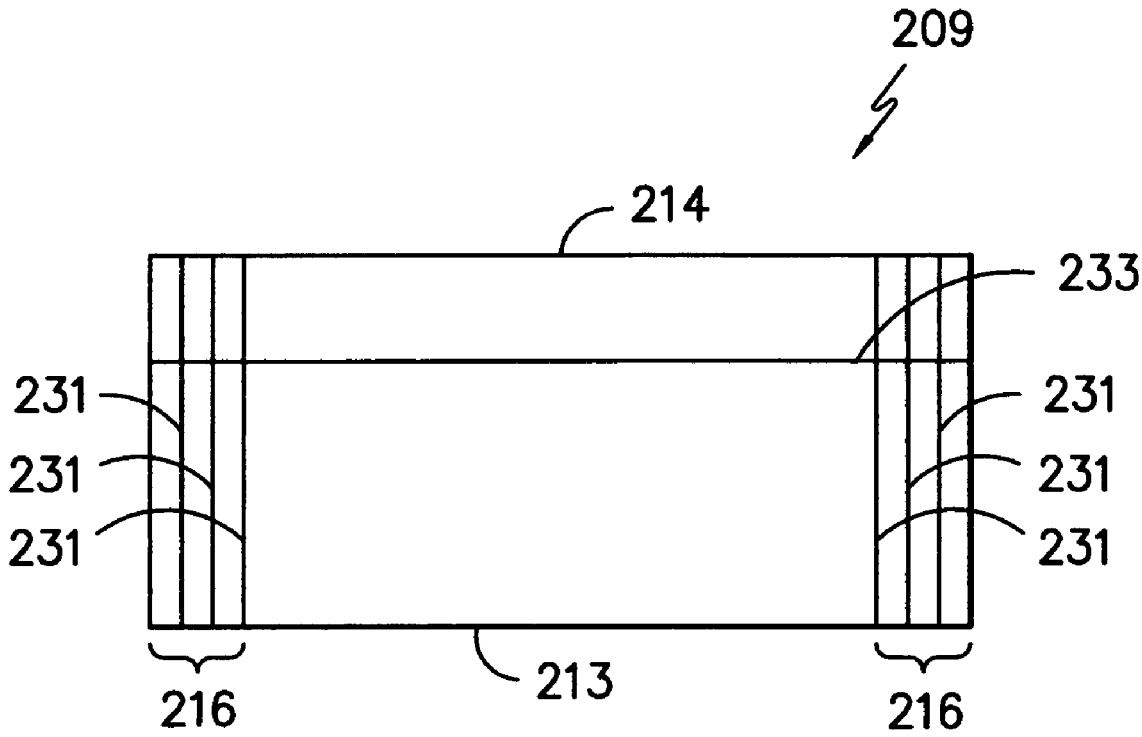
FIG. 4 illustrates a single piece of flat stock material for formation of a window cornice structure including an arrangement of score lines disposed across portions defining edges of the cornice structure and a scored hinge line between portions forming the face board and dust board segments of the final cornice.

In FIG. 4, another assembly is illustrated for formation of a window cornice wherein elements corresponding to those previously described are designated by like reference numerals in a 200 series. As shown, in this assembly a single piece foldable material blank 209 of felted construction material is utilized. An arrangement of vertical score lines 231 is located along the lateral edges of the material blank 209 so as to permit formation of the side boards 216 and to define the face panel 213. A hinge-forming substantially horizontal score line 233 is disposed at the intersection between the segment of the material blank defining the face panel 213 and the segment of the material blank defining the dust board 214. According to one potentially preferred practice, the portions of the vertical score lines disposed along the edges of the dust board 214 define a pattern for cutting away the appropriate amount of excess material in the upper corner portions to permit the side boards 216 to be folded inwardly along the lower portions of the appropriate vertical score lines when the dust board is folded down. Thus, a user will typically cut along the portion of the appropriate vertical score line at the upper corners to permit removal of excess outboard material above the horizontal score line 233 while using the portion below the horizontal score line to form the side boards.

As will be appreciated, in the assemblies illustrated in FIGS. 3 and 4, the segments of material forming the face panels 113, 213 are pre-cut along the lower edge so as to provide a desired shape. While the exemplary constructions are illustrated as having a substantially straight lower edge, it is also contemplated that virtually any other geometry may be precut into the lower edge. By way of example only, and not limitation, such geometries may include scallops, (as in FIG. 1), steps and the like. It is also contemplated that a user may shape the lower edge of the face panel to a desired geometry.

Figure 5:
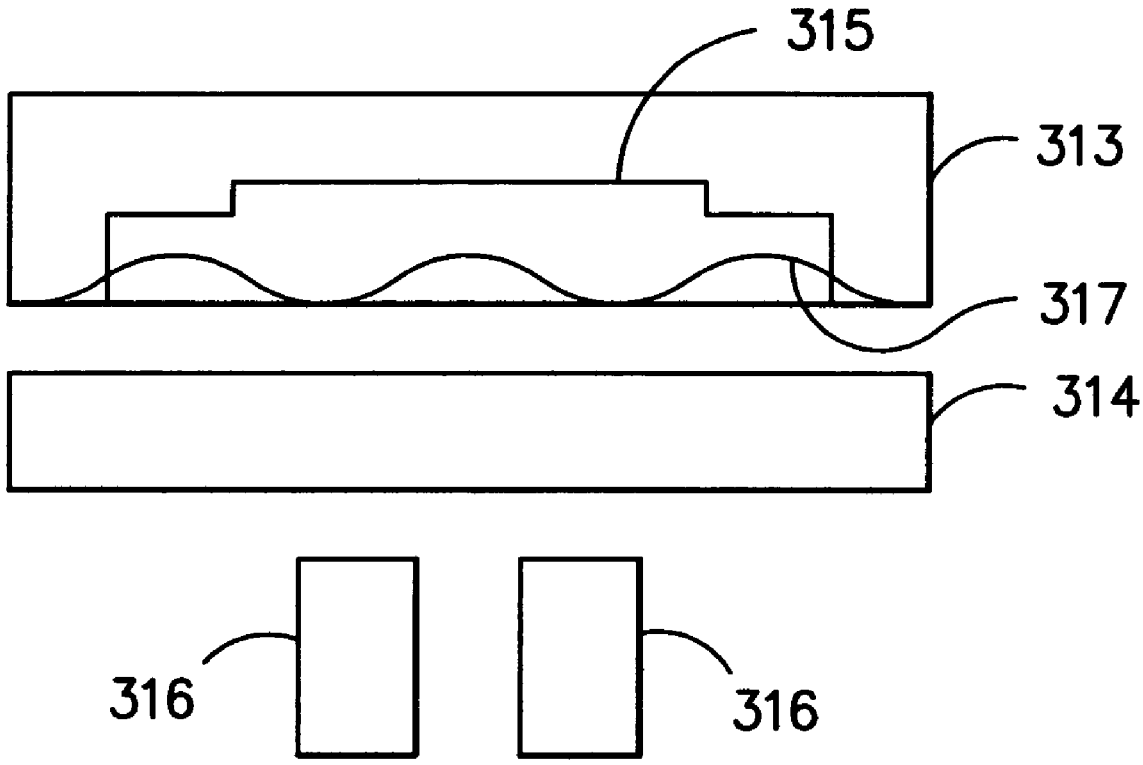
FIG. 5 is a view similar to FIG. 3, wherein the piece of stock material defining the face board of the cornice includes a multiplicity of pre-marked patterns for patterned cutting by a user.
Figure 6:
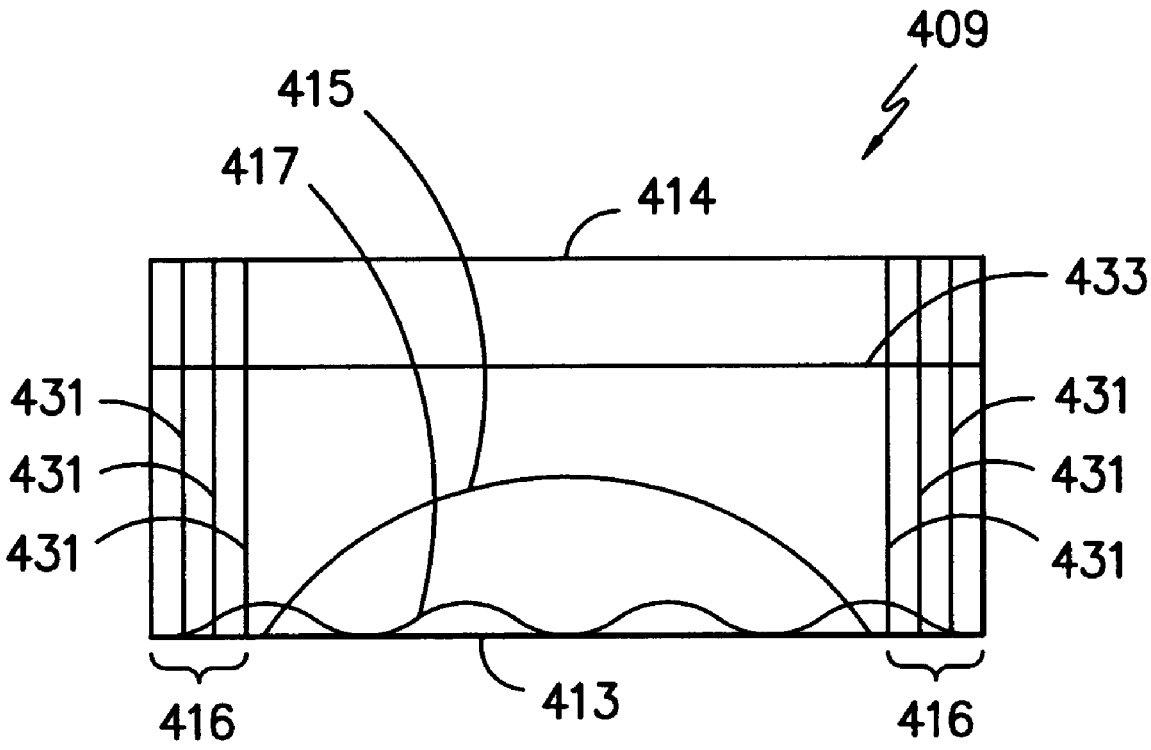
FIG. 6 is a view similar to FIG. 4, wherein the piece of stock material defining the face board of the cornice includes a multiplicity of pre-marked patterns for patterned cutting by a user.

FIGS. 5 and 6 illustrate assemblies adapted to be shaped by a user. In FIG. 5 there is shown an arrangement of separate panels substantially identical to those of FIG. 3, wherein elements corresponding to those previously described are designated by like reference numerals in a 300 series. In FIG. 6 there is shown single piece foldable material blank 409 substantially identical to that of FIG. 4, wherein elements corresponding to those previously described are designated by like reference numerals in a 400 series. In the assemblies of FIGS. 5 and 6, the face panel portion 313, 413 includes a number of premarked pattern lines 315, 317, 415, 417 for a user to cut along to form a desired lower edge geometry. That is, a user may select a desired geometry corresponding to one of the pattern lines and then cut along that pattern line to achieve such geometry. According to one contemplated practice, the pattern lines may be different colors to aid in following a continuous pattern. While only two pattern lines are illustrated, it is contemplated that any number of pattern lines may be provided. Of course, a user may opt not to contour along any of the pattern lines in which case a straight lower edge is achieved. The incorporation of such patterns thus permits a substantial reduction in manufacturing and marketing complexity since a single style may be adapted to provide a number of different constructions.

As will be appreciated, the felted material forming the structures as previously described must have sufficient dimensional stability to permit the various components to be joined to one another and thereafter used in a structural capacity. Surprisingly, it has been found that fibrous felted materials such as needlepunched felts may be constructed to provide these requisite strength characteristics. In addition, these felted materials may be constructed to retain a controlled degree of flexibility which is useful in the bending of components along score lines without fracture.

Figure 7:
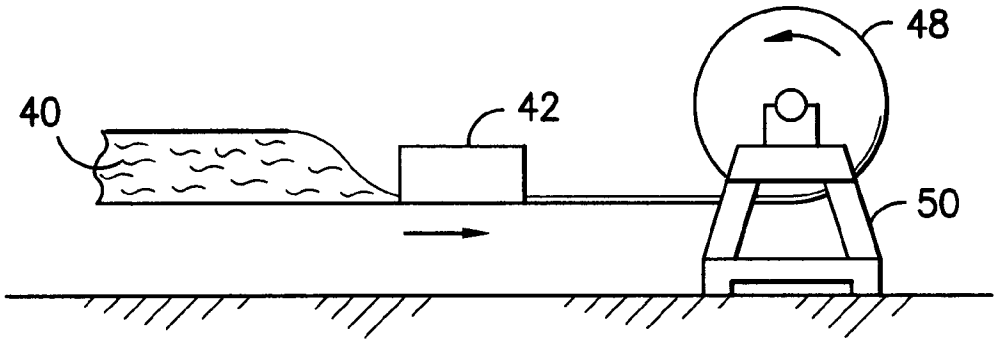
FIGS. 7 and 8 illustrate an exemplary practice for formation of felted construction material adapted for use in the interior design articles of the present invention.
Figure 8:
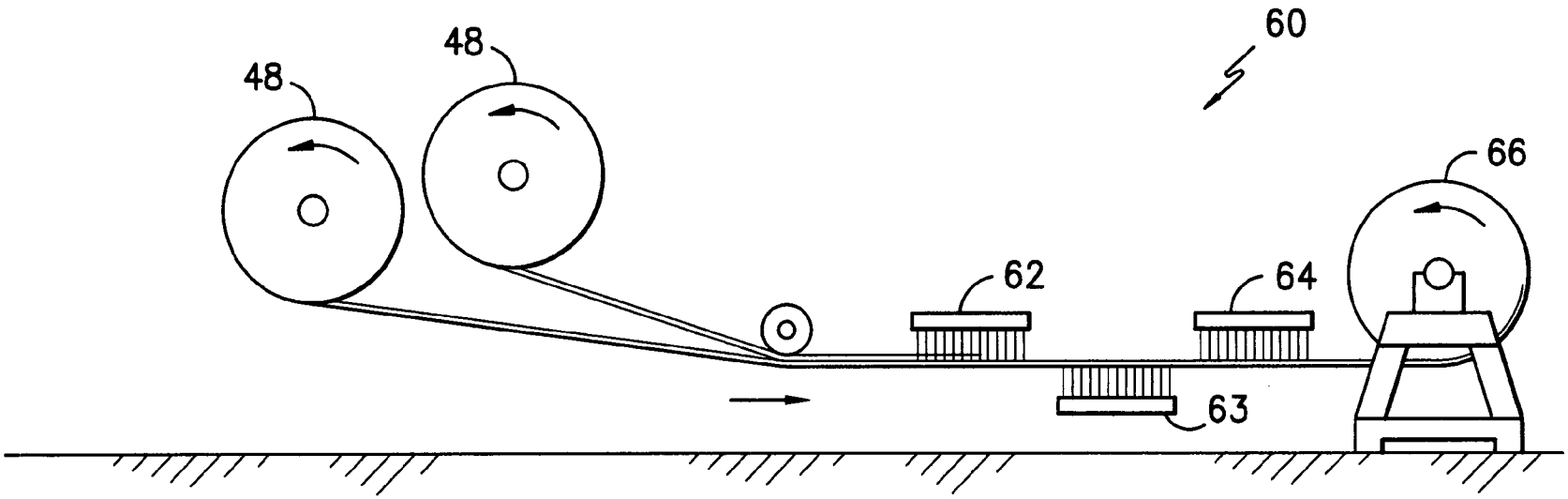
Figure 9:
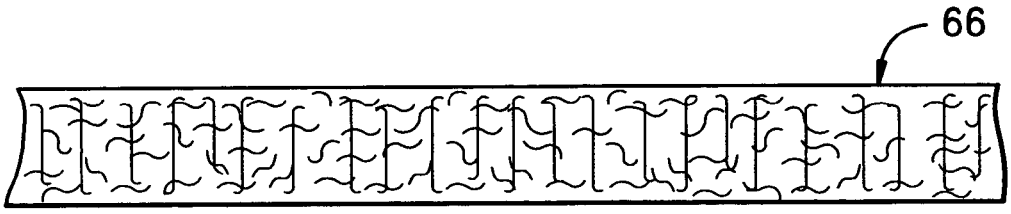
FIG. 9 is a schematic illustration of the felted construction material formed by the practice illustrated in FIGS. 10 and 11.

One exemplary practice for the production of a fibrous felted material suitable for formation into dimensionally stable decorative interior design components as previously described is illustrated schematically in FIGS. 7 and 8. According to the illustrated practice, a blend of discrete length staple fibers 40 is passed through a carding unit 42 to yield a carded web material 48 which is taken up on an "A" frame 50 or other collection device. The carded web material 48 is preferably a relatively light weight material having sufficient internal coherency to undergo further processing.

The blend of fibers 40 preferably includes some percentage of a relatively low melting point constituent so as to permit the heat activated point bonding of fibers to one another at later processing stages. According to one contemplated practice, the blend of fibers 40 is made up of substantially entirely of polyester with about 30 percent to about 90 percent (preferably about 70 percent) of the fibers 40 being a standard PET polyester staple fiber. By way of example only, one standard PET polyester staple fiber which is believed to be suitable is characterized by an average length of about 3 inches and a denier per filament rating of about 6 dpf. However, other staple fibers may likewise be utilized if desired. According to this practice about 10 percent to about 70 percent (preferably about 30 percent) of the fibers 40 are bi-component polyester fibers incorporating a sheath of low melting point CO-PET polyester around a standard PET polyester core. The core/sheath bicomponent polyester fiber preferably has a denier per filament rating of about 2.5 to about 5.5 dpf. One such core/sheath fiber construction is believed to be available from Hoechst Celanese Corporation having a place of business in Salisbury, N.C., USA. As will be appreciated, upon the application of heat, the sheath material undergoes preferential flow and bonding to surrounding fiber constituents. Of course, other forms of low melting point material such as discrete fibers of low melting point material may also be utilized. Likewise, at least some percentage of the fibers 40 may be materials other than polyester. By way of example, it is contemplated that such materials may include nylon, polypropylene and the like.

As illustrated in FIG. 8, following formation of the rolls of carded web material 48, according to a potentially preferred practice of the invention a plurality of such rolls of carded web material 48 may thereafter be conveyed through a combining and densification station 60. At the combining and densification station 60, the carded web material 48 is conveyed in layered orientation through a series of needle looms 62, 63, 64 to combine the layers of carded web material into a cohesive structure. According to one practice, the first needle loom 62 utilizes about fifty-two needles per inch in the machine direction in a thirty-two gauge regular barb spacing arrangement. The second needle loom 63 preferably has a greater needle density than the first needle loom 62. By way of example only, in one contemplated practice the second needle loom 62 utilizes one hundred twenty five needles per inch in the machine direction in a thirty-six gauge regular barb spacing arrangement. The third needle loom 64 preferably utilizes about fifty-two needles per inch in the machine direction in a thirty-six gauge regular barb spacing arrangement.

In one contemplated practice, needles in each of the needle looms 62, 63, 64 are generally triangular in shape with nine barbs per needle although other needle arrangements and designs may likewise be utilized if desired. The resultant product leaving the combining and densification station 60 is an enhanced density batting material 66. According to one potentially preferred practice, the enhanced density batting has a thickness in the range of about 0.45 to about 0.5 inches with a mass per unit area in the range of about 48.3 to about 51.2 ounces per square yard. Of course, it is to be understood that this enhanced density batting material 66 is exemplary only and that greater or lower thicknesses and/or different densities may likewise be utilized. In one contemplated practice, this enhanced density batting material is conveyed as a single layer to a heating press for compression and heat activation of the low melting point fiber constituents in a manner as will be described further hereinafter.

Figure 10:
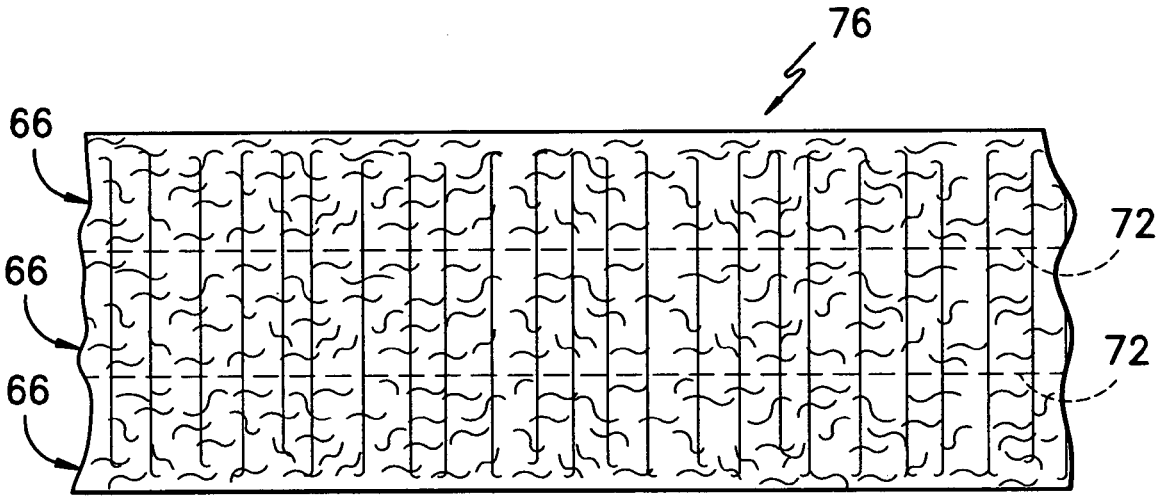
FIG. 10 is a schematic illustration of the multi-layer felted construction material formed by the exemplary practice illustrated in FIG. 11.
Figure 11:
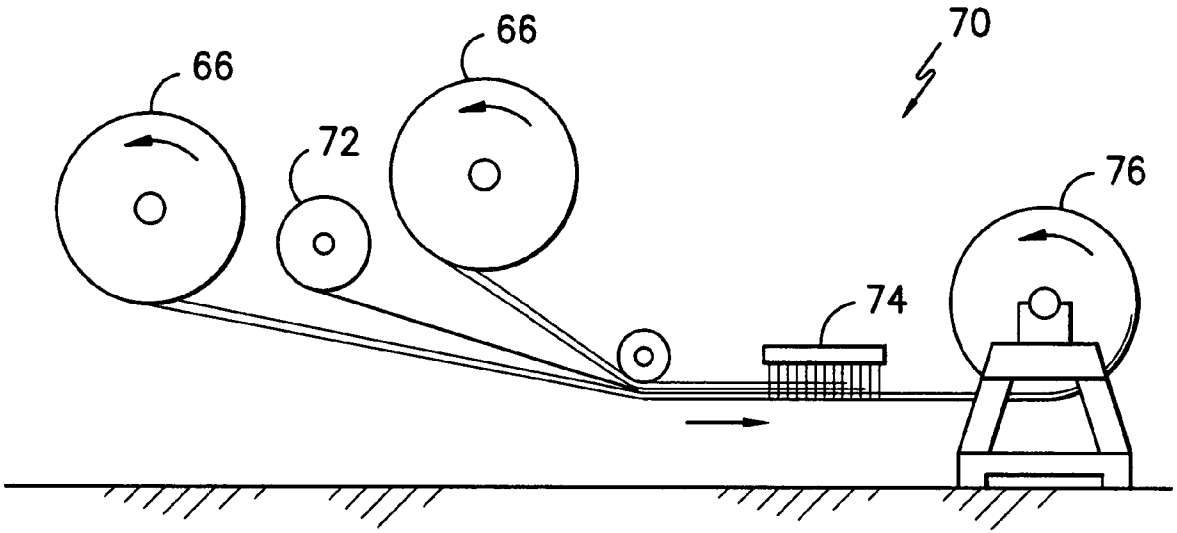
FIG. 11 illustrates an exemplary practice for formation of a multi-layer felted construction material adapted for use in the interior design articles of the present invention.

In the event that substantial thickness is desired in the article to be formed, it is contemplated that following formation of the enhanced density batting material 66, a plurality of rolls of such enhanced density batting material 66 may be conveyed to a laminate formation station 70 as illustrated schematically in FIG. 11. At the laminate formation station, the enhanced density batting material 66 is preferably conveyed in overlying and underlying relation to an intermediate layer of adhesive material 72 thereby forming a multi-layer sandwich structure 76 in which the adhesive material 72 is disposed between layers of enhanced density batting material 66. As will be appreciated, while the schematic processing line illustrated in FIG. 11 incorporates only two layers of enhanced density batting material 66, a larger number of layers of enhanced batting material 66 may likewise be used to form a sandwich structure with three or more layers as illustrated in FIG. 10.

According to the practice illustrated in FIG. 11, the juxtaposed layers of adhesive material 72 and enhanced batting material 66 are conveyed through an entangling needle loom 74 which serves to mechanically intermingle a portion of the fibers 40 from one or more layers of enhanced density batting material 66 with the adhesive material 72 and with the adjacent layer of batting or other material as may be incorporated within the sandwich structure 76 thereby mechanically binding fibers from the adjacent layers of the sandwich structure 76 together and increasing overall strength. Such a mechanical joining operation preferably results in a portion of the fibers 40 extending substantially across the boundary between two or more layers of the layered sandwich structure 76.

While the adhesive material 72 may be any wet or dry adhesive as may be suitable to bind the adjacent layers of felted material together, it is contemplated that the adhesive material 72 will preferably be a dry adhesive in web form so as to promote ease of use of the adhesive in roll form and to further permit the relatively easy mechanical entangling to be carried out across the adhesive by the needle loom 74. The adhesive material is preferably of a nature such that it can be activated upon demand through application of a predetermined driving force such as heat, hot gas, chemical interaction, ultrasonic energy, radio frequency radiation waves and the like. Further, it is contemplated that the adhesive should provide necessary resistance to heat, humidity and chemical interaction so as to avoid any premature delamination. One such heat activated adhesive fabric is believed to be available under the trade designation SPUNFAB® adhesive fabric from Dry Adhesive Technologies Inc. having a place of business at Cuyahoga Falls, Ohio, USA. According to a potentially preferred embodiment, the adhesive is SPUNFAB® type PA 1001 polyamide spunbonded adhesive fabric. However, other such adhesive fabrics of polyester, polyolefin, and ternary systems are also contemplated.

Figure 12:
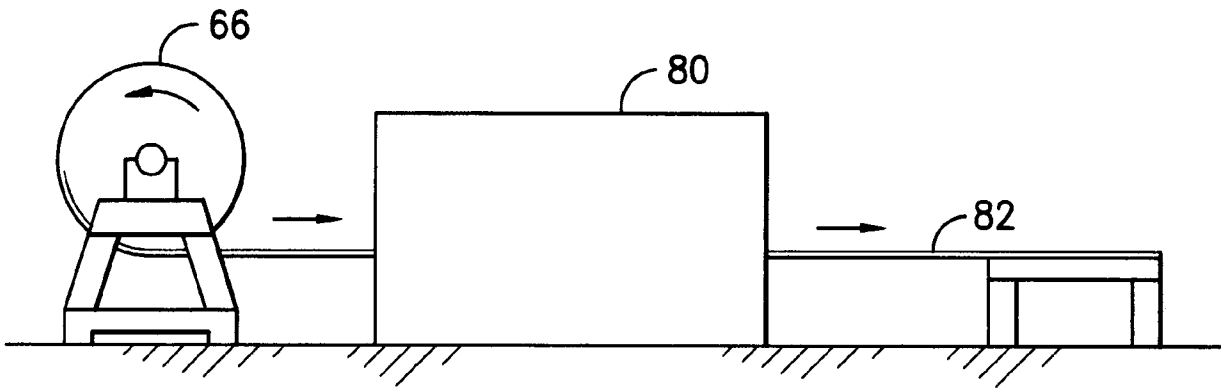
FIG. 12 illustrates schematically the heat fusion of felted construction material.

Regardless of whether a single layer structure or multilayer structure is desired, it is contemplated that either a single layer of the enhanced density batting material 66 or the multi-layer sandwich structure 76 as previously described will preferably be conveyed through a hot press 80 (FIG. 12) to activate the low melting point fiber constituent as well as any heat activated adhesive layers. According to one contemplated practice, the enhanced density batting material 66 or the multi-layer sandwich structure 76 is heated to a temperature of approximately 340 degrees Fahrenheit for a period sufficient to activate the low melting point fiber constituent. By way of example only, for a single layer structure having a starting thickness of about 0.5 inches, the period of heating will normally be about 6 minutes. The application of heat and pressure causes the low melting point material forming the sheath of the bicomponent fiber constituent to flow and form fusion bonding points with adjacent fibers once cooling takes place. The resultant heat fused felted fiber material 82 in either single layer or multi-layer form is preferably characterized by a thickness in the range of about 0.04 inches to about 2 inches with a mass per unit area in the range of about 6 ounces per square yard to about 400 ounces per square yard and a density of about 0.065 ounces per cubic inch to about 0.210 ounces per cubic inch. By way of example only, one heat fused compressed construction which is believed to be particularly versatile is a single layer construction having a thickness in the range of about 0.394 inches to about 0.480 inches (most preferably about 0.437 inches) with a mass per unit area of about 90 ounces per square yard to about 110 ounces per square yard (most preferably about 100 ounces per square yard). Multiple layer constructions may have similar densities although the mass per unit area may be greater. Of course, other density levels may likewise be utilized if desired.

The felted fiber material 82 is sufficiently stiff to be cut into board stock for subsequent formation into various interior decorative articles and furniture as previously described. However, due to the felted nature of the material and the fact that stiffness is imparted by a distribution of fusion bonding points between fibers, the material nonetheless retains a degree of flexibility permitting relatively easy bending manipulation. In this regard it is contemplated that stiffness may be adjusted as desired by adjusting the percentage of low melting point material in the fiber blend. In particular, it is contemplated that increasing the percentage of bicomponent fiber will result in increased stiffness due to the occurrence of a greater concentration of fusion bonding points. Likewise, reducing the percentage of bicomponent fiber will result in reduced stiffness due to the lower concentration of fusion bonding points. As previously indicated, the fiber blend preferably contains in the range of about 10 percent to about 70 percent bicomponent fibers. Importantly, it has also been found that localized bending may be enhanced by the incorporation of score lines extending partially but not completely through the material at locations where bending is desired. Preferably such score lines are generally "V" shaped with the apex projecting into the felted material. However, other cross-sectional geometries may likewise be utilized if desired.

As indicated, it is contemplated that the felted fiber material 82 used in forming the decorative articles and furniture according to the present invention may be useful over a wide range of thicknesses ranging from about 0.04 inches to about 2 inches. In this regard it is to be noted that if the panel is to have a thickness substantially greater than about ½ inch, the use of a multi-layer construction with an intermediate adhesive layer may be desirable.

It is to be understood that while the present invention has been illustrated and described in relation to potentially preferred embodiments, constructions, and procedures, such embodiments, constructions, and procedures are illustrative only and that the present invention is in no event to be limited thereto. Rather, it is contemplated that modifications and variations embodying the principles of the present invention will no doubt occur to those of ordinary skill in the art. It is therefore contemplated and intended that the present invention shall extend to all such modifications and variations as may incorporate the broad aspects of the present invention within the true scope and spirit thereof.

The invention claimed is:

1. A three dimensional window treatment structure adapted for disposition along at least an upper edge of a window, said window treatment structure comprising a folded panel comprising a first segment defining a face board portion of the window treatment structure and a second segment defining a dust board portion of the window treatment structure and wherein a score line is disposed at the intersection between the first segment and the second segment defining a hinge between the first segment and the second segment and wherein a plurality of score lines are disposed along opposing lateral edges of the first segment in transverse orientation to the score line defining the hinge between the first segment and the second segment such that segments of the folded panel outboard of the score lines along opposing lateral edges of the first segment define foldable side board portions of the window treatment structure, the folded panel comprising a fibrous felted material of entangled polymeric fibers wherein at least a portion of said entangled polymeric fibers are melt fused together such that a plurality of fiber to fiber fusion bonding points are distributed within said fibrous felted material and wherein the window treatment structure is an open bottom comice, the first segment and the second segment being displaceable in hinging relation around the score line at the intersection between the first segment and the second segment to define a substantially right angle relation between the face board portion and the dust board portion at the score line.

2. The invention as recited in claim 1, wherein said fibrous felted material consists essentially of a blend of entangled polyester fibers.

3. The invention as recited in claim 2, wherein the blend of entangled polyester fibers includes a first portion of polyester fibers characterized by a first melting point and at least a second portion of polyester fibers comprising a low melting point polyester constituent characterized by a second melting point which is lower than the first melting point.

4. The invention as recited in claim 3, wherein at least a percentage of said second portion of polyester fibers comprise a sheath of said low melting point polyester constituent disposed in surrounding relation to a core of polyester having a melting point greater than the low melting point polyester constituent.

5. The invention as recited in claim 3, wherein the low melting point polyester constituent is characterized by a melting point of less than about 340 degrees Fahrenheit.

6. The invention as recited in claim 1, wherein the fibrous felted material is characterized by a thickness in the range of about 0.04 to about 2 inches and a density in the range of about 0.065 to about 0.21 ounces per cubic inch.

* * * * *